United States Patent [19]

Ruff

[11] 4,176,417

[45] Dec. 4, 1979

[54] ROTARY-TILLER TINE CLEANING TOOL

[76] Inventor: Glen T. Ruff, Rte. 1, Box 27, DeValls Bluff, Ark. 72041

[21] Appl. No.: 921,641

[22] Filed: Jul. 3, 1978

[51] Int. Cl.[2] ..... B26B 11/00

[52] U.S. Cl. ..... 7/161; 15/105

[58] Field of Search ..... 29/76 R, 81 G; 15/93 R, 15/105, 236 R; 76/82, 82.1; 7/161, 169

[56] References Cited

U.S. PATENT DOCUMENTS

| | | | |
|---|---|---|---|
| D. 53,161 | 4/1919 | Vicario | 7/169 X |
| 368,876 | 8/1887 | Cowie | 15/104.4 |
| 1,145,966 | 7/1915 | Bergmann | 15/104.4 |
| 1,355,574 | 10/1920 | Ryberg | 15/104.4 |
| 1,461,686 | 7/1923 | Stone | 7/169 X |
| 3,310,826 | 3/1967 | Ellis | 15/105 |
| 3,820,185 | 6/1974 | Phillips | 15/105 |

FOREIGN PATENT DOCUMENTS

| | | | |
|---|---|---|---|
| 25424 | 11/1908 | United Kingdom | 7/169 |

*Primary Examiner*—James G. Smith
*Attorney, Agent, or Firm*—Ralph R. Pittman

[57] ABSTRACT

A one-piece tool for removing tangles of weeds, grasses and associated debris from the rotatable earth-working tines of a rotary soil tiller has a pair of spaced coplanar cutting blades extending outwardly from one end of an intermediate elongate handle portion. In cross section, each blade has the shape of a non-rectangular quadrangle, and the line of juncture of those sides bounding the acute angles of the quadrangle define transversely spaced cutting edges along the innermost and outermost portions of the blades. A forwardly directed cutting edge is presented for scraping a fouled tine positioned between the blades as the tool is moved either inwardly or outwardly along the tine. In addition to the lateral cutting edges, the outer end of each cutting blade is tapered to a knife edge. A modification includes an abrasive surface along the intermediate handle portion.

10 Claims, 6 Drawing Figures

11
12
10
23
13
14
22

11
12
23
5
13
16
15
17
19
14
20
18
21

13
17
16
13
15
17
19
18
20

10
12

10
13
14
15
16
19
18

12
21

10
22
20
17

ROTARY-TILLER TINE CLEANING TOOL

BACKGROUND OF THE INVENTION

The herein described invention relates to a tool particularly adapted for facilitating the removal of the commingled mass of weeds, grasses and soil which accumulates on the tines or fingers of a rotary soil tiller. Such tangles of fibrous material and soil often adhere tightly to the rotary elements, are difficult to clear away and unless removed, seriously reduce or completely destroy the usefulness of the tiller.

A large number of cleaning tools are found in the prior art disclosures, under such titles as pipe scrapers, curettes, grill cleaners and boiler tube and flue cleaners, and while certain of these tools may be helpful in removing tangled debris from a rotary tiller, none appear to be suitably adapted or constructed, probably for the reason that none were either intended or appropriately structured for such duty.

SUMMARY OF THE INVENTION

The cleaning tool described herein is a single piece of inflexible material having an elongate flat bar intermediate portion joined at one end to a rearwardly directed hook portion and at the other end to a bifurcated portion defining a pair of spaced coplanar forwardly directed cutting blades.

The intermediate portion provides a handle for manipulating the tool; the hook end is useful in pulling fibrous material from the tiller and the cutting blades are utilized for scraping fiber-impregnated soil from the digging tines.

The cutting blades are configured to facilitate the above described scraping procedure, each blade being shaped in cross section as a non-rectangular quadrangle wherein the linear junctures of the sides defining acute angles are the innermost and outermost portions of each of the blades.

This blade configuration together with the mutual relationship therebetween enables scraping contact of either one or the other of the adjacent opposed edges with a tine disposed therebetween regardless of the direction of movement of the tool, since these cutting edges slope in opposite directions.

Also described herein is a modified embodiment which includes an array of sharp ridges along the surface of the intermediate portion, thereby providing an abrading element suitable for sharpening the tines of the tiller.

DESCRIPTION OF THE PREFERRED EMBODIMENT

Figures 1, 2, 3, 4, 5, 6:
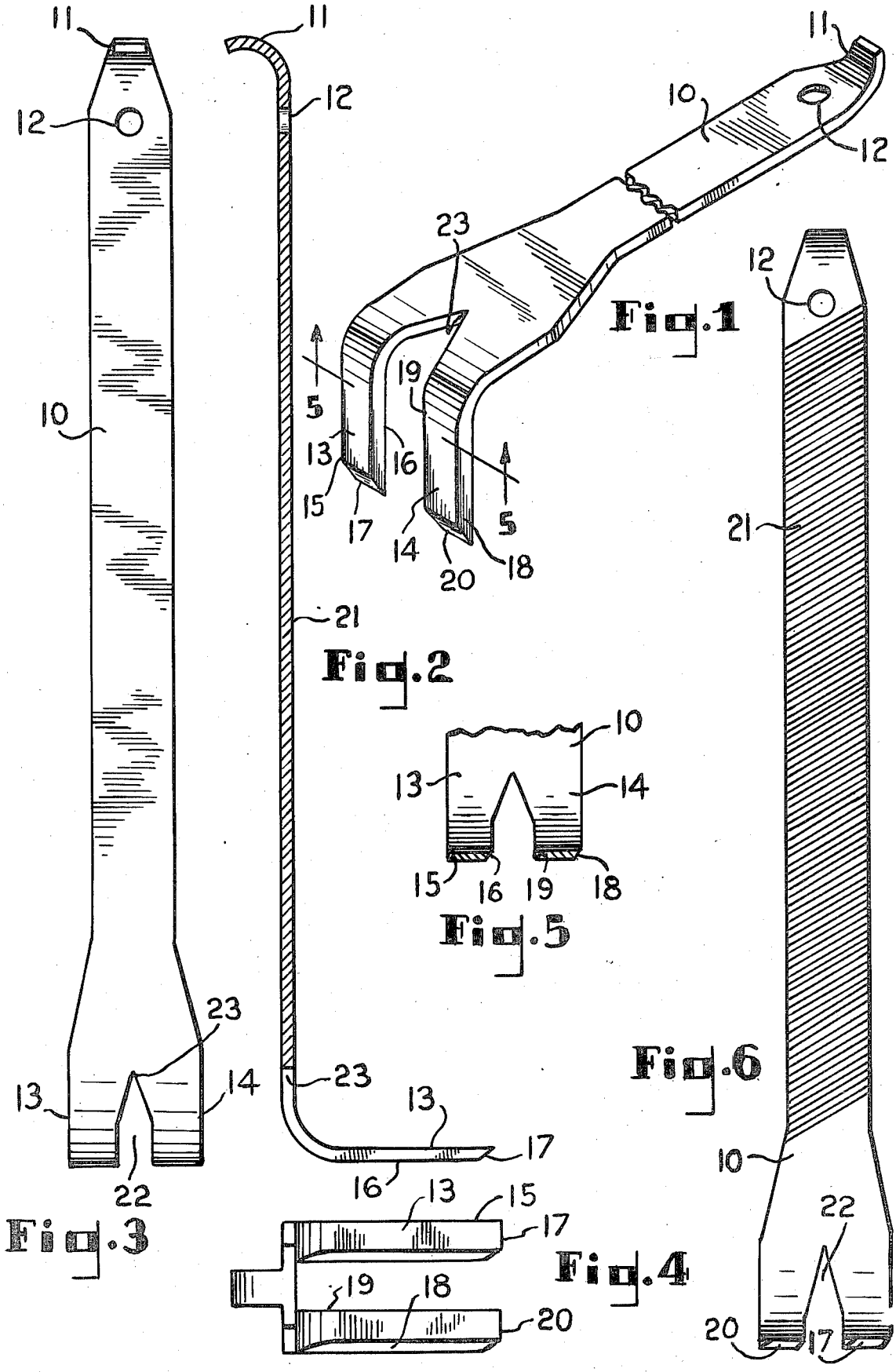
FIG. 1 is a perspective view of the tool from the bifurcated end, particularly showing an inner and an outer sloped cutting edge along the forwardly projecting blades.
FIG. 2 is a side elevational view of the tool, shown in section.
FIG. 3 is a rear elevational view of the tool.
FIG. 4 is a plan view of the tool.
FIG. 5 is a fragmentary view of the blades of the tool, showing the non-rectangular sectional shape of the blades.
FIG. 6 is a modified embodiment of the tool, in which the surface of the intermediate portion is ridged as a single cut file.

As shown in FIGS. 1 through 5, the tool is a one-piece article having an elongate intermediate flat-bar portion 10. One end portion of the tool is tapered and rearwardly curved to provide the hook end 11, and an aperture 12 at the hook end is provided for hanging the tool. The other end portion of the tool is bifurcated from the intermediate portion 10, as indicated at the numeral 23. The bifurcations are equal in length and extend forwardly to provide a pair of spaced coplanar cutting blades 13 and 14.

The four forwardly extending sides of each of the blades 13 and 14 define in cross section a non-rectangular quadrangle having two diagonally opposed acute angles, and the junction lines of the sides along the vertices of the acute angles define respectively outside and inside knife edges 15 and 16 of one blade and 18 and 19 of the other blade.

The knife edge 16 along the inner side of the blade 13 is sloped for cutting when moved in one direction; the knife edge 19 along the inner and adjacent side of the blade 14 is sloped for cutting when moved in the other direction.

The adherent foreign material accumulated on a digging tine is most quickly removed by positioning a fouled tine in the space 22 between the cutting blades 13 and 14, then moving the blades with a concurrent diagonal and lengthwise movement along the tine, the knife edges 16 and 19 being alternately pressed toward the tine as the tool is moved therealong.

To enable the desired diagonally transverse movement along a tine, the length of the blades 13 and 14 are preferably at least three times their spacing 22. The hook 11 is useful for removing thickly deposited fibrous masses; also for this purpose the knife edges 17 and 20 at the outer ends of the cutting blades are tapered from the outer surface thereof and extend transversely across the associated blade.

In the modification shown at FIG. 6, an abrading surface is added along a portion 21 of the surface of the intermediate portion of the tool, here shown as a single cut file. The material of this structure is preferably a hardenable tool steel, although other well known abrasive constructions may be chosen for incorporating a tine-sharpening facility in the herein described tine cleaning tool.

I claimed:

1. A tool for removing debris from a rotary soil tiller, said tool comprising:

a single piece of inflexible material having an elongate intermediate flat bar portion and first and second end portions projecting therefrom;

the first end portion being curved to define a hook extending rearwardly from said intermediate portion;

the second end portion being bifurcated and defining a pair of coplanar cutting blades extending forwardly in spaced relationship from said intermediate portion;

each of said blades having four linearly extending sides defining in transverse cross section a quadrangle of which two of the enclosed angles are acute angles, the linear junctures of the sides defining the acute angles being disposed respectively along the innermost and outermost lateral margins of each of said blades; and the projection of said blades being equal in magnitude and at least three times the spacing therebetween.

2. The tool claimed in claim 1, wherein each of said blades is non-rectangularly parallelogrammic in transverse cross section.

3. The tool claimed in claim 1, in which said cutting blades extend normally forward from said intermediate portion.

4. The tool claimed in claim 1, in which said cutting blades are disposed in parallel relationship.

5. The tool claimed in claim 1, in which the end portion of each of said blades tapers to a knife edge extending transversely across the associated blade.

6. The tool claimed in claim 1, wherein the forward projection of each cutting blade is at least twelve times the thickness thereof.

7. The tool claimed in claim 1, in which the thickness of each cutting blade is at least one-third of the spacing therebetween.

8. The tool claimed in claim 1, wherein said intermediate flat bar portion is a hardened steel file.

9. A one-piece tool for removing debris from a rotary soil tiller, said tool comprising an intermediate elongate abrasive flat bar portion and first and second end portions extending outwardly therefrom, said first end portion defining a narrowed hook and said second end portion being bifurcated to define a pair of spaced coplanar cutting blades, each of said blades tapering to a knife edge both along each side and along each outer end, each of said cutting blades having four linearly extending sides defining in transverse cross section two acute angles, the junctures of the sides defining acute angles being disposed respectively along the innermost and outermost lateral margins of each of said blades.

10. The tool claimed in claim 9, wherein each of said blades is non-rectangularly parallelogrammic in cross section.

* * * * *